US008878742B1

(12) United States Patent
Jenn

(10) Patent No.: US 8,878,742 B1
(45) Date of Patent: Nov. 4, 2014

(54) DIPOLE WITH AN UNBALANCED MICROSTRIP FEED

(71) Applicant: David C. Jenn, Monterey, CA (US)

(72) Inventor: David C. Jenn, Monterey, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 169 days.

(21) Appl. No.: 13/760,386

(22) Filed: Feb. 6, 2013

Related U.S. Application Data

(60) Provisional application No. 61/599,308, filed on Feb. 15, 2012.

(51) Int. Cl.
*H01Q 9/16* (2006.01)

(52) U.S. Cl.
CPC ..... *H01Q 9/16* (2013.01)
USPC ..... 343/793

(58) Field of Classification Search
CPC ..... H01Q 9/16
USPC ..... 343/793, 795, 820, 821, 822
See application file for complete search history.

(56) References Cited

U.S. PATENT DOCUMENTS

| | | | | |
|---|---|---|---|---|
| 8,648,759 | B2 * | 2/2014 | Wang et al. | 343/770 |
| 8,686,912 | B2 * | 4/2014 | Bin Jamlus et al. | 343/795 |
| 2005/0057416 | A1 * | 3/2005 | Yuanzhu | 343/795 |

* cited by examiner

*Primary Examiner* — Robert Karacsony
(74) *Attorney, Agent, or Firm* — Naval Postgraduate School; Lisa A. Norris

(57) ABSTRACT

Embodiments in accordance with the invention include a linearly polarized dipole antenna with an unbalanced microstrip feed line. More specifically, embodiments in accordance with the invention utilize a fed dipole connected to a microstrip feed line, and separated a gap distance from a parasitic dipole not connected to the microstrip feed line. When an electrical signal is input to the microstrip feed line, the microstrip feed line creates a current flow in the fed dipole which induces a nearly equal current on the parasitic dipole that is out of phase. The result is a current flow, I, in the same direction in both fed and parasitic dipoles allowing for efficient radiation of the linearly polarized dipole antenna. Embodiments in accordance with the invention eliminate the need for a balun circuit thereby reducing the size, complexity and feed loss of the feed circuit. Embodiments in accordance with the invention are effective for dipoles with relatively small ground planes.

11 Claims, 10 Drawing Sheets

500

DIPOLE WITH AN UNBALANCED MICROSTRIP FEED

CROSS-REFERENCE TO RELATED APPLICATIONS

This application claims the benefit of U.S. Provisional Application No. 61/599,308 filed Feb. 15, 2012, which is hereby incorporated in its entirety by reference.

BACKGROUND OF THE INVENTION

1. Field of the Invention

The present invention relates generally to dipole antennas.

2. Description of the Related Art

Linearly polarized dipole antennas are commonly used in communication and radar applications. Dipoles can be used individually or as elements in an array antenna. Often a dipole antenna is fed using a microstrip feed line. Microstrip feed lines are utilized in many applications because the devices connected to the dipole are often printed on microstrip boards.

Prior art dipole structures utilized a balanced structure that generally required a balanced-to-unbalanced circuit, also termed a balun circuit, or simply a balun, when fed by a microstrip line. Depending on how the balun circuit was implemented, it had the undesired effect of increasing either the depth or area of the assembly. FIGS. 1A/1B and 2A/2B show instances of prior art dipole antennas utilizing balun circuits. In FIGS. 1A/1B and 2A/2B, the balun circuit is used to split a single input line into a two wire line for connecting to the dipole antenna. FIGS. 1A/1B illustrate how the prior art vertical implementation of a balun circuit increased the depth of the assembly by utilizing area on the vertical ground plane of the assembly. FIGS. 2A/2B illustrate how the prior art horizontal implementation of the balun circuit increased the area of the assembly by utilizing area on the horizontal ground plane of the assembly.

SUMMARY OF THE INVENTION

Embodiments in accordance with the invention include a linearly polarized dipole antenna with an unbalanced microstrip feed line which eliminate the need for a balun circuit thereby reducing the size, complexity and feed loss of the feed circuit. Embodiments in accordance with the invention are effective for dipoles with relatively small ground planes. In accordance with one embodiment, a linearly polarized dipole antenna with an unbalanced microstrip feed including: a substrate having a top surface and a back surface; a microstrip feed line in contact with the back surface of said substrate, the microstrip feed line having an input end for accepting an electrical signal; a ground plane having a top surface and a back surface, wherein the back surface of said ground plane is in contact with at least a portion of the top surface of the substrate, the ground plane further having a ground plane aperture in the top surface of the ground plane that exposes at least a portion of the substrate; a first conductive element having a first vertical stem and a first horizontal arm, wherein a first end of the first conductive element extends through said ground plane aperture through the substrate and contacts the microstrip feed line; and a second conductive element having a second vertical stem and a second horizontal arm, wherein the second vertical stem is spaced a gap distance, g, apart from the first vertical stem, and further wherein a first end of the second conductive element extends through the ground plane aperture through the substrate and is connected to the back surface of said substrate.

Embodiments in accordance with the invention are best understood by reference to the following detailed description when read in conjunction with the accompanying drawings.

Embodiments in accordance with the invention are further described herein with reference to the drawings.

DETAILED DESCRIPTION OF THE INVENTION

Figure 1B:
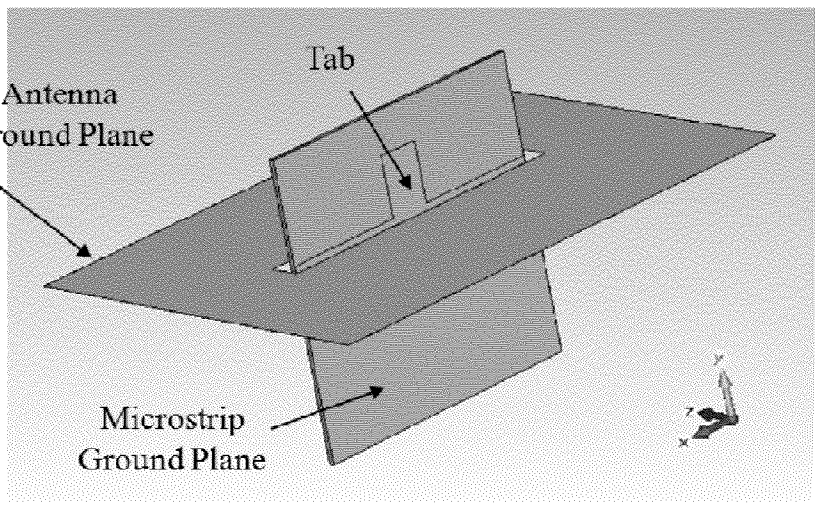
FIG. 1B (Prior Art)
FIG. 1B illustrates a back side view of a prior art vertical implementation of a balun circuit.
Figure 1A:
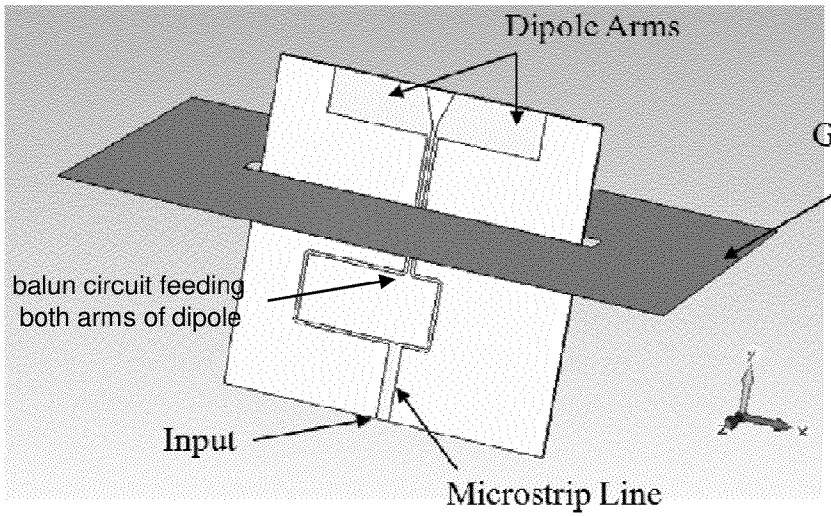
FIG. 1A (Prior Art)
FIG. 1A illustrates a front side view of a prior art vertical implementation of a balun circuit.
Figure 2B:
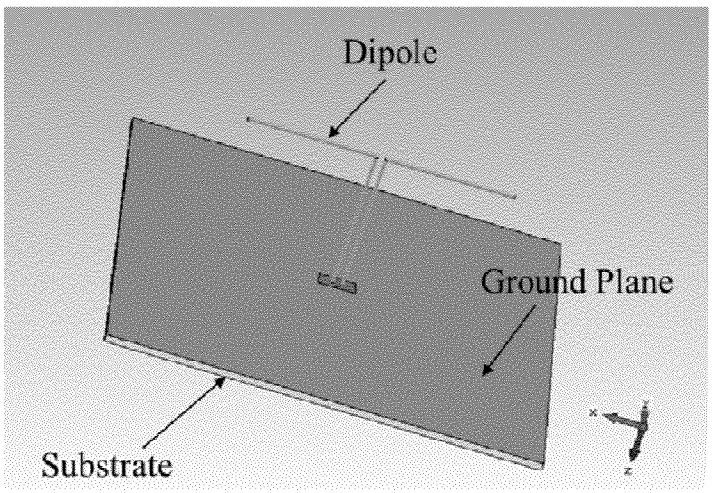
FIG. 2B (Prior Art)
FIG. 2B illustrates a top side view of a prior art horizontal implementation of a balun circuit.
Figure 2A:
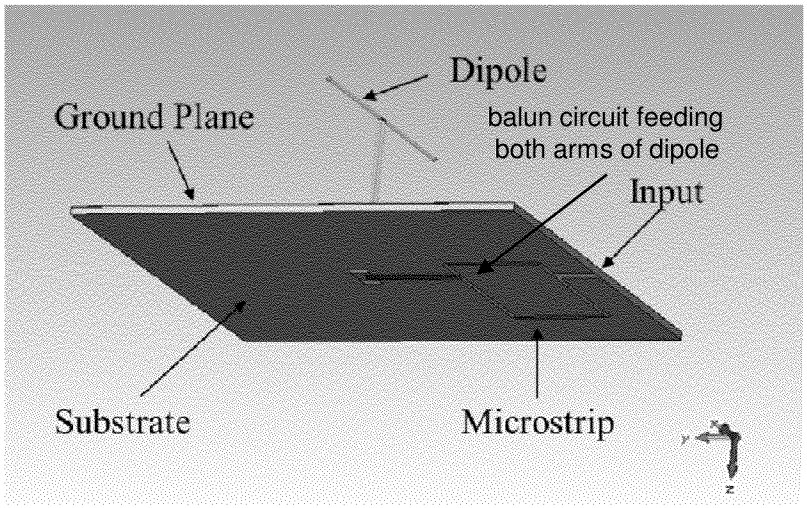
FIG. 2A (Prior Art)
FIG. 2A illustrates a bottom side view of a prior art horizontal implementation of a balun circuit.
Figure 3A:
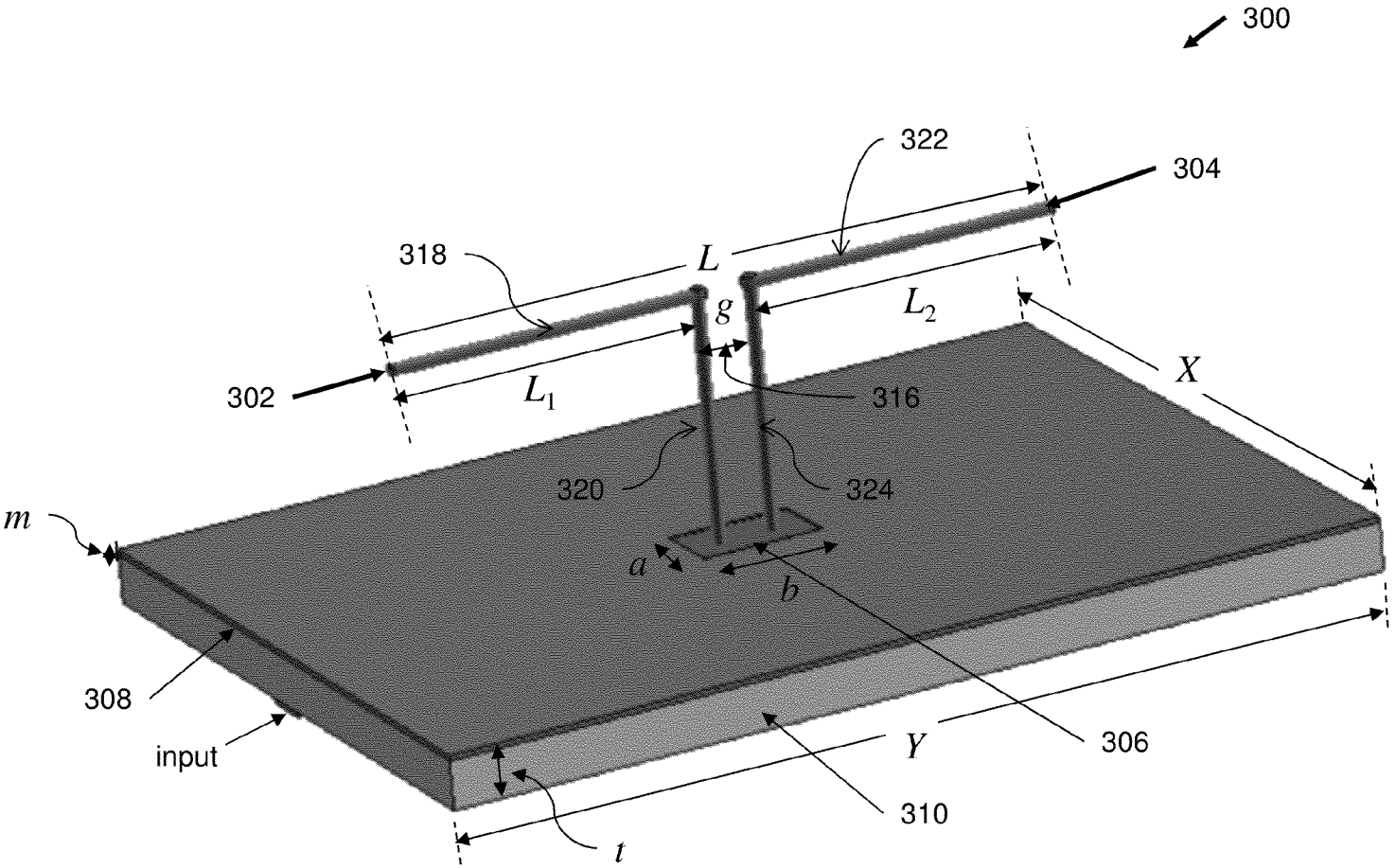
FIG. 3A illustrates a transverse top view of a linearly polarized dipole assembly with unbalanced microstrip feed in accordance with one embodiment.
Figure 3B:
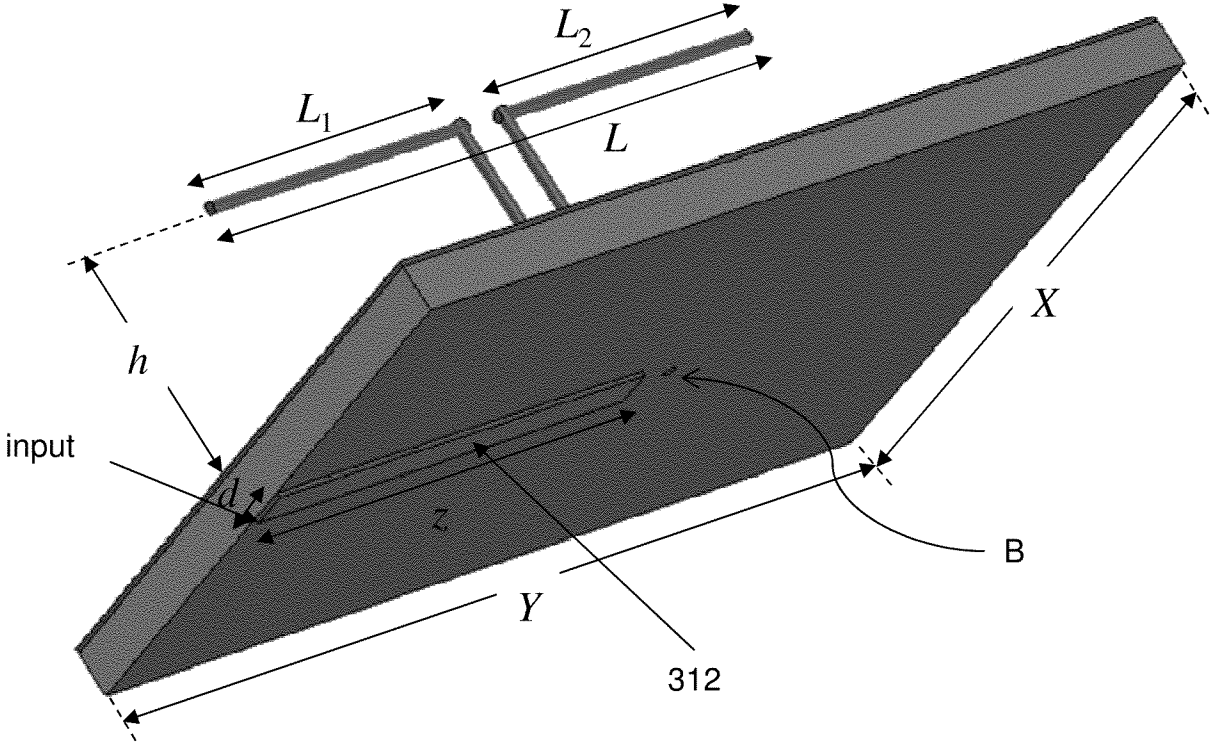
FIG. 3B illustrates a transverse bottom view of the linearly polarized dipole assembly of FIG. 3A in accordance with one embodiment.
Figure 3C:
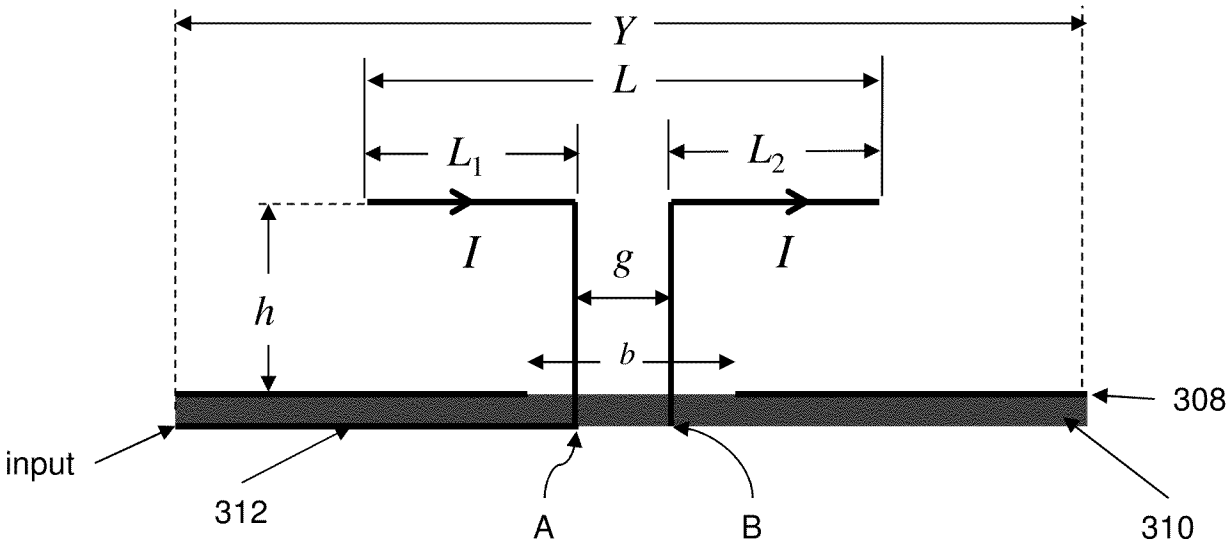
FIG. 3C illustrates a cross-sectional side view of the linearly polarized dipole assembly of FIG. 3A in accordance with one embodiment.

FIGS. 3A and 3B and 3C illustrate a linearly polarized dipole antenna assembly with unbalanced microstrip feed line in accordance with one embodiment. FIG. 3A illustrates a transverse top view of a linearly polarized dipole assembly 300 with unbalanced microstrip feed line in accordance with one embodiment. FIG. 3B illustrates a transverse bottom view of the linearly polarized dipole assembly of FIG. 3A in accordance with one embodiment. FIG. 3C illustrates a side view of the linearly polarized dipole assembly of FIG. 3A in accordance with one embodiment.

Referring to FIGS. 3A, 3B, and 3C, in one embodiment, linearly polarized dipole antenna assembly 300 includes two elements: a conductive first dipole element 302, and a conductive second dipole element 304. In one embodiment, a first end of first dipole element 302 extends through a ground plane aperture 306 in a top surface of a ground plane 308 through a substrate 310 and is attached to a microstrip feed line 312 at a point A at a back surface of substrate 310. A first end of second dipole element 304 extends through ground plane aperture 306 through substrate 310 and is attached at a point B to the back surface of substrate 310. This arrangement of first dipole element 302 and second dipole element 304 can also be generally described as a bent monopole with a parasitic element. The remaining portions of first dipole element 302 and second dipole element 304 extend above the top surface of ground plane 308. In one embodiment, first dipole element 302 and second dipole element 304 are positioned apart from each other at a gap distance 316, g.

In one embodiment, first dipole element 302 includes a first horizontal arm 318 of first length, L1, and a first vertical stem 320 of height, h, where height, h, is measured from the top surface of ground plane 308 to first horizontal arm 318. Second dipole element 304 includes a second horizontal arm 322 of second length, L2, and a second vertical stem 324 of height, h. In one embodiment, first dipole element 302 is formed of a conductive material, such as a metal wire of radius, r, and second dipole element 304 is formed of a conductive material, such as a metal wire of radius, r. In one embodiment, first dipole element 302 and second dipole element 304 are formed of the same conductive material, such as a metal wire having the same radius, r. In one embodiment, the metal wire can be copper. In other embodiments, other conductive metals or combination of metals can be used, dependent upon the application. In alternate embodiments, first dipole element 302 and second dipole element 304, can be formed of different conductive materials and/or have different radii, with resultant changes in radiation patterns.

In one embodiment, the overall length of the dipole assembly, L, is defined as L1+L2+g, i.e., the first length plus the second length plus the gap distance 316. In one embodiment, the first length, L1, is equal to second length, L2, and each of L1 and L2 is equal to L/2−g/2, i.e., the overall length divided by two minus the gap distance, g, divided by two.

In one embodiment, a back surface of ground plane 308 is attached to, or formed on, a top surface of substrate 310. Ground plane aperture 306 is formed in ground plane 308 exposing substrate 310 and allowing first dipole element 302 and second dipole element 304 to be extended through the top surface of substrate 310 to the back surface of substrate 310. On the back surface of substrate 310, a first end of first element 302 is attached to microstrip feed line 312 at a point A. Microstrip feed line 312 is formed on, or attached to, the back surface of substrate 310. A first end of second element 304 is attached to the back surface of substrate 310 at a point B, but second element 304 is not connected to microstrip feed line 312.

In one embodiment, ground plane 308 is formed of a conductive metal and has a thickness, m. In one embodiment, the conductive metal can be copper. In other embodiments, other conductive metals or combination of metals can be used, dependent upon the application. In one embodiment, ground plane 308 serves as the ground plane for the dipole assembly, i.e., first dipole element 302 and second dipole element 304, as well as the ground plane for microstrip feed line 312. In one embodiment ground plane 308 has dimensions width, X, by length, Y. In various embodiments, the dimensions X and Y of ground plane 308 can be varied, depending on the requirements of the application. In one embodiment, substrate 310 is formed of a dielectric material of thickness, t, and relative dielectric constant, E. In one embodiment, microstrip feed line 312 is formed having a line width, d, and length, z.

As described above, first dipole element 302 is attached to a first end of microstrip feed line 312 at a point A. A second end of micro strip feed line 312, also termed the input end of microstrip feed line 312, is available for input of an electrical signal from a signal source (not shown) and powering of dipole assembly 300. The signal source can be attached to microstrip feed line 312, or other devices and circuit elements can be mounted directly on microstrip feed line 312.

In an alternate embodiment, a support medium is placed on the top surface of ground plane 308 through which first vertical stem 320 and second vertical stem 324 extend allowing first horizontal arm 318 and second horizontal arm 322 to rest on a top surface of the support medium. In this way the support medium provides structural support and protection to first dipole element 302 and second dipole element 304.

Figure 4A:
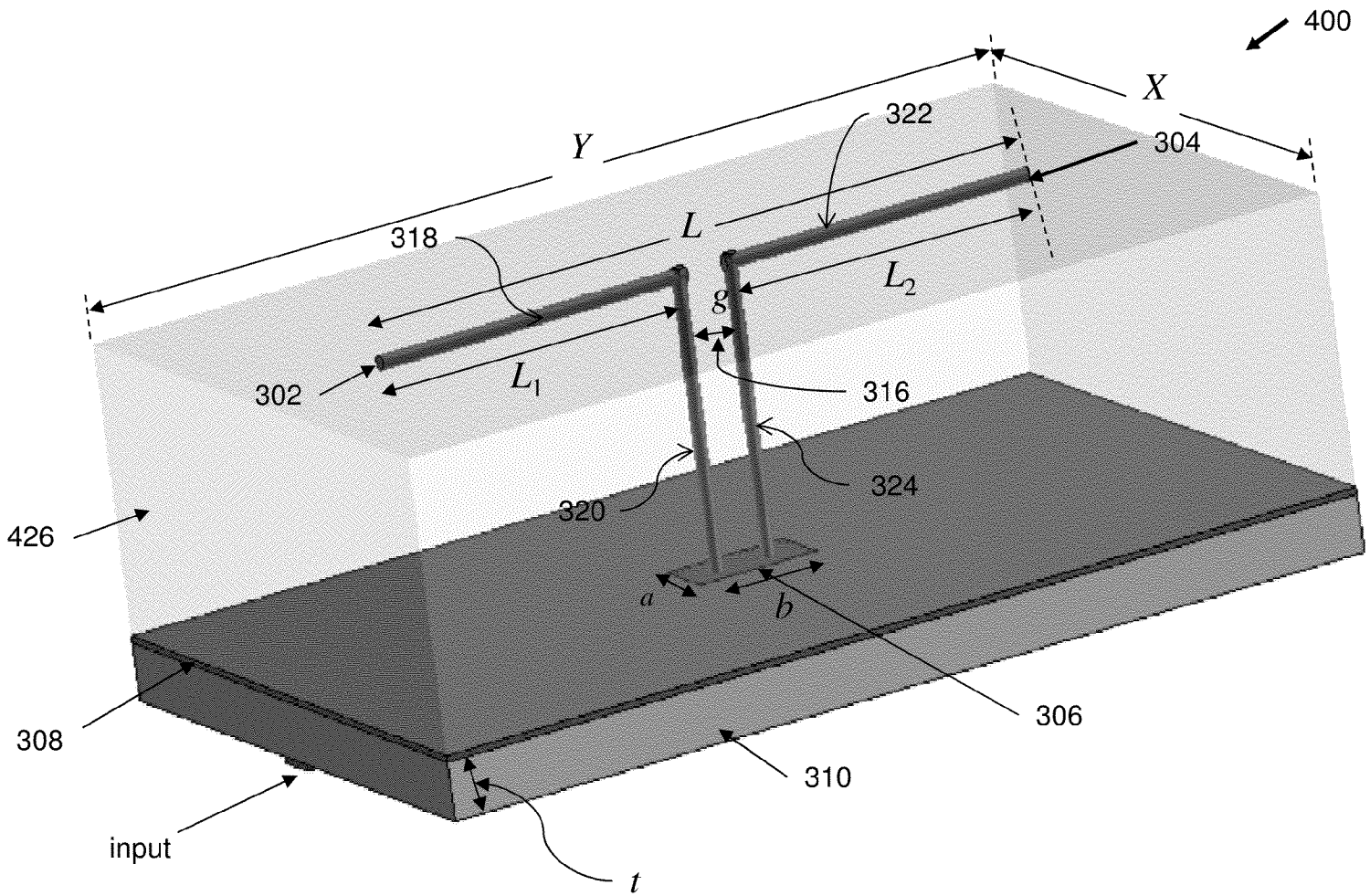
FIG. 4A illustrates a transverse top view of a linearly polarized dipole assembly with unbalanced microstrip feed of FIG. 3A including a support medium in accordance with another embodiment.
Figure 4B:
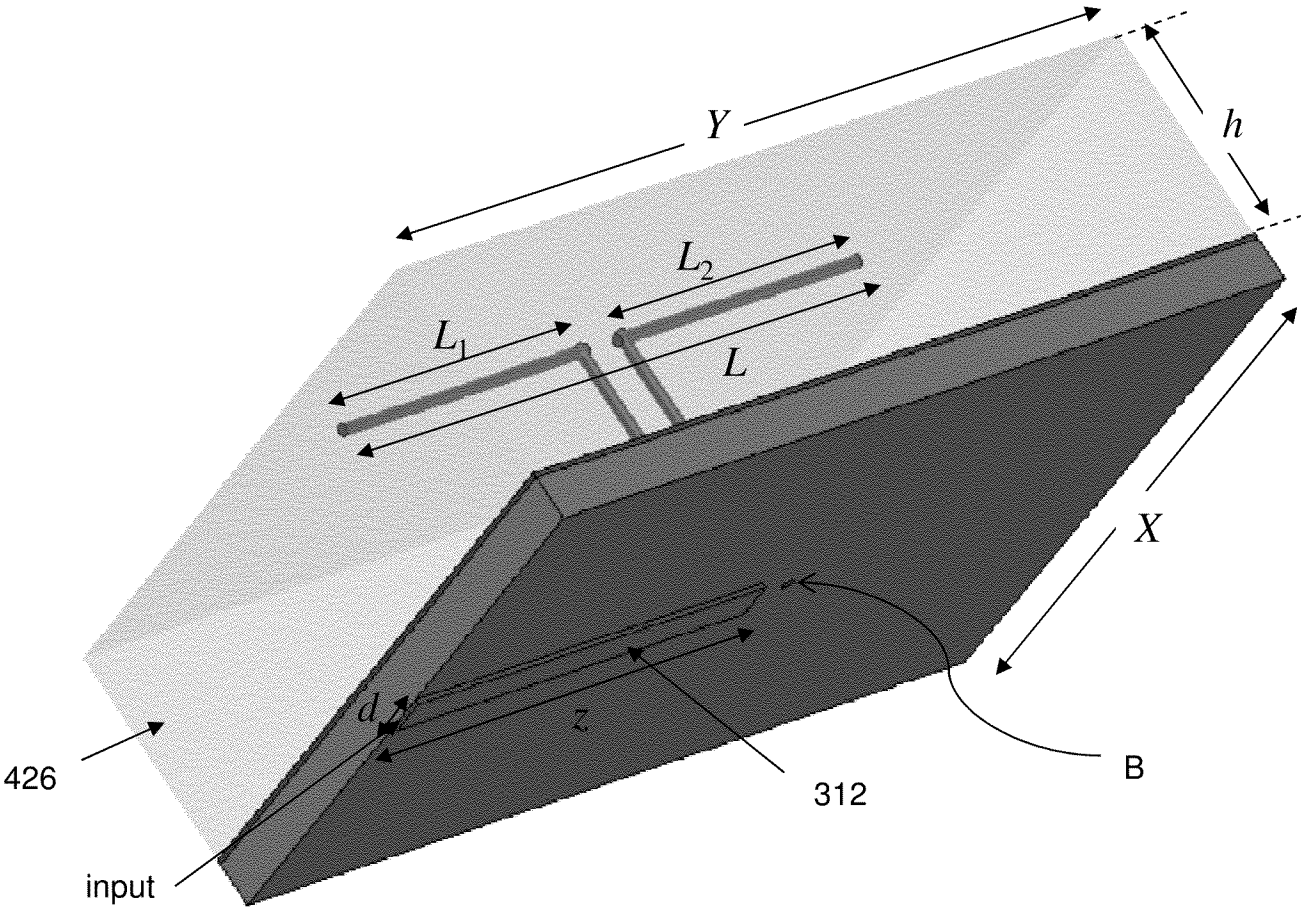
FIG. 4B illustrates a transverse bottom view of the linearly polarized dipole assembly of FIG. 4A in accordance with another embodiment.
Figure 4C:
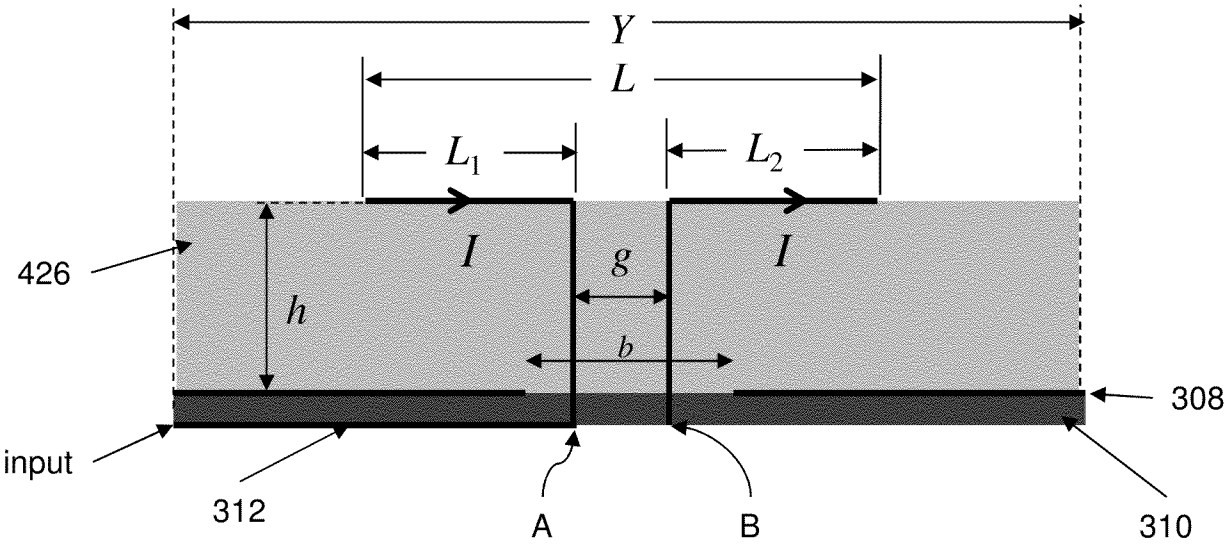
FIG. 4C illustrates a cross-sectional side view of the linearly polarized dipole assembly of FIG. 4A in accordance with another embodiment.

FIGS. 4A and 4B and 4C illustrate a linearly polarized dipole antenna assembly 400 with an unbalanced microstrip feed including a support medium 426 in accordance with another embodiment. FIG. 4A illustrates a transverse top view of a linearly polarized dipole assembly with unbalanced microstrip feed of FIG. 3A including a support medium 426 in accordance with another embodiment. FIG. 4B illustrates a transverse bottom view of the linearly polarized dipole assembly of FIG. 4A in accordance with another embodiment. FIG. 4C illustrates a cross-sectional side view of the linearly polarized dipole assembly of FIG. 4A in accordance with another embodiment.

In one embodiment, support medium 426 is placed on the top surface of ground plane 308 through which first vertical stem 320 and second vertical stem 324 extend allowing first horizontal arm 318 and second horizontal arm 322 to rest on a top surface of support medium 426. In this way support medium 426 provides structural support and protection to first dipole element 302 and second dipole element 304. In some embodiments, support medium 426 is a foam block spacer of thickness, h, which is placed over the top surface of ground plane 308. In other embodiments, different materials can be utilized for support medium 426.

When a signal source (not shown) is connected to microstrip feed line 312, due to the small gap distance 316, g, current flows in first dipole element 302 and induces a nearly equal current on the open arm of parasitic second dipole element 304 that is out of phase according to Lentz's law. The result is a current flow, I, in the same direction in first dipole element 302 and second dipole element 304, allowing for efficient radiation. The resulting radiation pattern is nearly identical to that of a conventionally fed dipole for small ground plane sizes.

As the size of ground plane 308 becomes larger, the radiation pattern becomes more asymmetrical, which is undesirable for many applications. This occurs because currents induced on ground plane 308 and first vertical stem 318 of first dipole element 302 are not equal to those induced on parasitic second dipole element 304. However, the impedance match is relatively unaffected by the size of ground plane 308 and in many applications the variation in the gain inside of the half power beam widths, i.e., gain ripple, is not a problem as long as the gain is above a specified minimum value.

In one embodiment, the physical dimensions of the dipole, i.e., first dipole element 302 and second dipole element 304, and ground plane 308 are selected so that first dipole element 302 and second dipole element 304 are "tuned" (resonant) and the impedance is matched to that of microstrip feed line 312, for example, in one embodiment, 50 ohms. The tuning can be achieved using standard antenna design techniques and commercially available computer software. Parameters that can be adjusted include the dipole radius, r, dipole height above the ground plane, h, dipole length from end to end L, the area (a by b) of the ground plane aperture 306, the dimensions, X by Y of ground plane 308, and the distance of the gap distance 316, g, between first dipole element 302 and second dipole element 304. The thickness, t, of substrate 310, the width, d, of microstrip feed line 312, and relative dielectric constant, &, determine microstrip feed line 312 characteristic impedance. Widely available and well-known formulas exist for calculating the impedance as a function of these parameters.

Table 1 illustrates parameters of a sample design of a dipole assembly, such as shown in FIGS. 4A, 4B, and 4C with an unbalanced microstrip feed in accordance with one embodiment.

TABLE 1

| Parameter | Variable | Value |
|---|---|---|
| Dipole length | L | 25 mm |
| Dipole radius | r | 0.25 mm |
| Gap | g | 1.5 mm |
| Dipole height | h | 9 mm |
| Microstrip line width ($Z_o$ = 50) | d | 1.6829 mm |
| Ground plane length in x | X | 35 mm |
| Ground plane length in y | Y | 35 mm |
| Ground plane aperture length in x | a | 2.5 mm |
| Ground plane aperture length in y | b | 3.5 mm |
| Substrate thickness | t | 0.508 mm |
| Substrate relative dielectric constant | $\epsilon_{r_m}$ | 1.96 |
| Support medium thickness | h | 9 mm |
| Support medium relative dielectric constant | $\epsilon_{r_s}$ | 1.04 |

Figure 5:
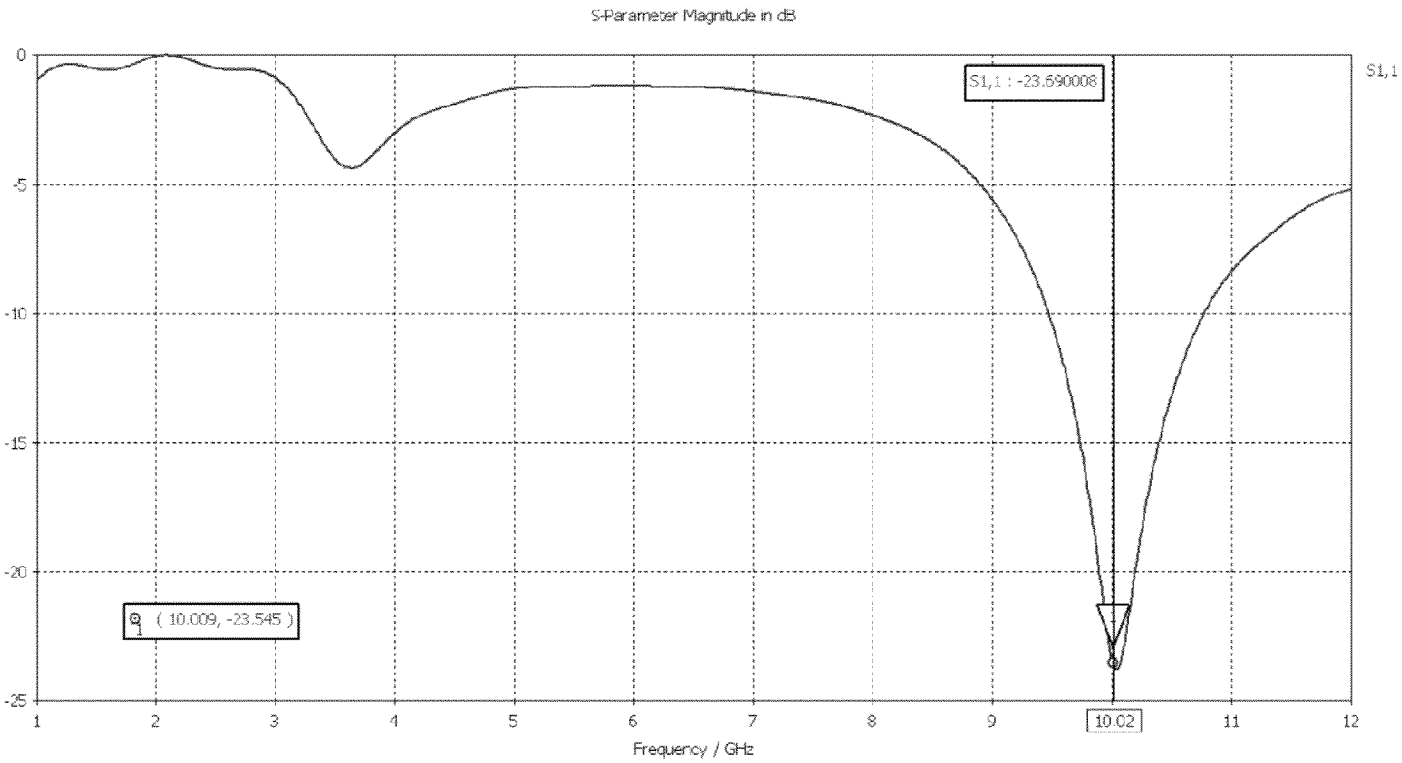
FIG. 5 illustrates a return loss plot (in dB) showing good match to a 50 ohm microstrip line at 10 GHz for a sample design of a dipole with unbalanced microstrip feed in accordance with one embodiment.
Figure 7:
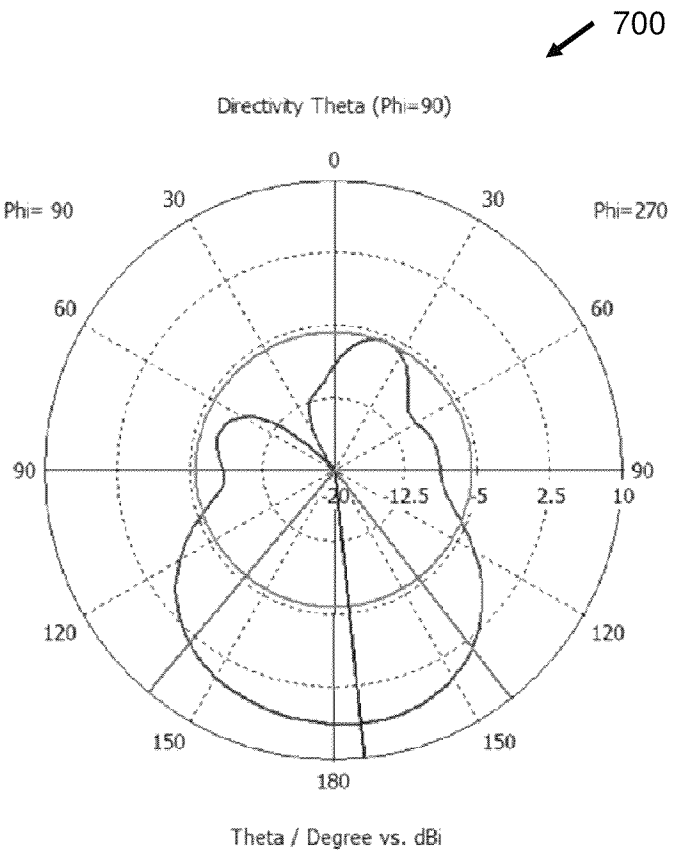
FIG. 7 illustrates an E-plane radiation pattern for the sample design in accordance with one embodiment.
Figure 6:
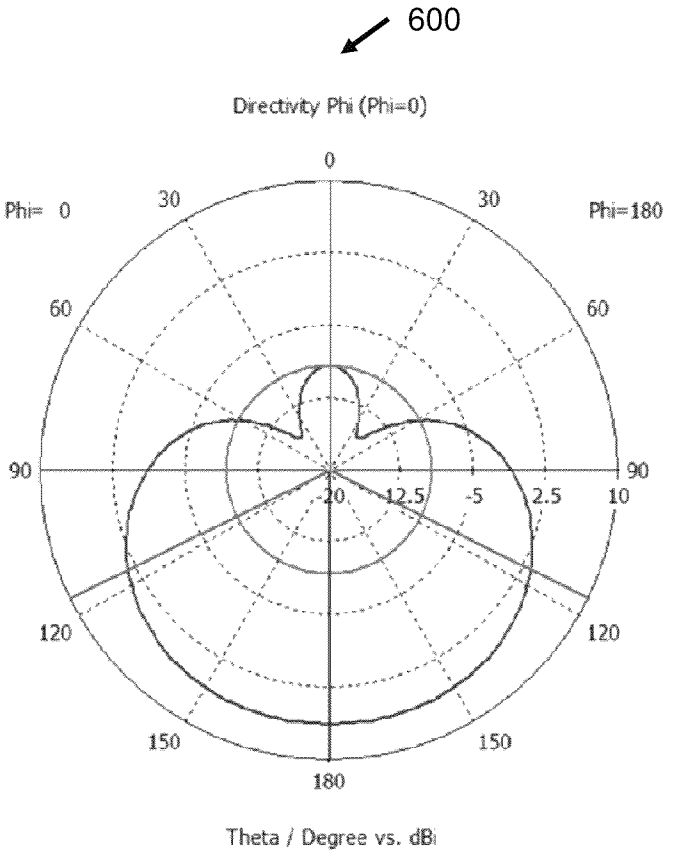
FIG. 6 illustrates an H-plane radiation pattern for the sample design in accordance with one embodiment.

FIG. 5 illustrates a return loss plot 500 (in dB) showing good match to a 50 ohm microstrip line at 10 GHz for the sample design of Table 1. FIG. 6 illustrates an H-plane radiation pattern 600 for the sample design of Table 1. FIG. 7 illustrates an E-plane radiation pattern 700 for the sample design of Table 1.

As earlier discussed, when receiving an input signal, the resulting radiation pattern of dipole assembly 300/400 is nearly identical to that of a conventionally fed dipole for small ground plane sizes. As the size of ground plane 308 becomes larger, the radiation pattern becomes more asymmetrical, which is undesirable for most applications. This occurs because currents induced on ground plane 308 and first vertical stem 318 of first dipole element 302 are not equal to those induced on parasitic second dipole element 304. In some embodiments, it is possible in some cases to restore the symmetry in the radiation pattern by introducing asymmetry into the geometry of the dipole assembly. In various embodiments, the height, h, or length, L2, of parasitic second dipole element 304, can be made different than the height, or length, L1, of the fed first dipole element 302.

Also, the length of ground plane 308 on the side on which first element 302 is located (relative to a center line of length, Y) can be made different from the length of ground plane 308 on the side on which second element 304 is located. In this embodiment, ground plane aperture 306 would not be centered at Y/2 on ground plane 308 and would be offset.

Embodiments in accordance with invention described herein can be made using conventional fabrication techniques. For example, substrate 310, ground plane 308, ground plane aperture 306, and microstrip feed line 312 can be manufactured using conventional fabrication techniques, for example, conventional techniques of deposition, patterning, and/or etching. In some embodiments, some or all of the above elements can be separately manufactured using conventional fabrication techniques and then assembled. First dipole element 302 and second dipole element 302 can be fabricated using conventional dipole manufacturing techniques, such as manufacturing and shaping a selected wire having a selected radius, r. In various embodiments, vias can be formed in substrate 310 to permit the first end of first dipole element 302 and the first end of second dipole element 304 to pass through substrate 310 and allow attachment at points A and B, respectively. In one embodiment, the vias can be formed mechanically, while in other embodiments, the vias can be formed using conventional fabrication techniques of deposition, patterning, and/or etching. In one embodiment support medium 426 can be a foam block as earlier described, which is shaped in accordance with the size parameters of ground plane 308 and height, h. During assembly support medium 426 is placed over ground plane 308 and first dipole element 302 and second dipole element 404 are inserted through support medium 426, through ground plane aperture 306 and substrate 310 and attached respectively at points A and B.

Embodiments in accordance with the linearly polarized unbalanced microstrip fed dipole assembly described herein are simple, low loss and compact. Embodiments in accordance with the invention are easily integrated into micro strip structures. Embodiments in accordance with the invention have applicability as a "rectenna", also termed a rectifying antenna. Rectennas are used in converting microwave signals to direct current for wireless power and energy harvesting applications. Important civilian and military applications are for powering small UAVs, satellite station keeping, and wireless battery charging. Most prior art rectenna structures can only provide half wave rectification, however, embodiments in accordance with the invention can easily be extended to provide full-wave rectification with resultant efficiencies.

This disclosure provides exemplary embodiments of the present invention. The scope of the present invention is not limited by these exemplary embodiments. Numerous variations, whether explicitly provided for by the specification or implied by the specification or not, may be implemented by one of skill in the art in view of this disclosure.

What is claimed is:

1. A linearly polarized dipole antenna with an unbalanced microstrip feed comprising:

a substrate having a top surface and a back surface;

a microstrip feed line in contact with said back surface of said substrate, said microstrip feed line having an input end for accepting an electrical signal;

a ground plane having a top surface and a back surface, wherein said back surface of said ground plane is in contact with at least a portion of said top surface of said substrate, said ground plane further having a ground plane aperture in said top surface of said ground plane that exposes at least a portion of said substrate;

a conductive first dipole element having a first vertical stem and a first horizontal arm, wherein a first end of said first dipole element extends through said ground plane aperture through said substrate and contacts said microstrip feed line; and a conductive second dipole element having a second vertical stem and a second horizontal arm, wherein said second vertical stem is spaced a gap distance, g, apart from said first vertical stem, and further wherein a first end of said second dipole element extends through said ground plane aperture through said substrate and is connected to said back surface of said substrate.

2. The linearly polarized dipole antenna with an unbalanced microstrip feed of claim 1 wherein application of an input signal to said input end of said microstrip feed line creates current flow in said first dipole element and induces a nearly equal current on said second dipole element that is out of phase resulting in a current flow, I, in the same direction as in said first dipole element and producing radiation.

3. The linearly polarized dipole antenna with an unbalanced microstrip feed of claim 1 further comprising:

a support medium having a top surface and a back surface, wherein said back surface of said support medium is located above and in contact with said top surface of said ground plane, wherein said first vertical stem and said second vertical stem extend through said support medium to said ground plane aperture.

4. The linearly polarized dipole antenna with an unbalanced microstrip feed of claim 3 wherein said first horizontal arm and said second horizontal arm are in contact with said top surface of said support medium.

5. The linearly polarized dipole antenna with an unbalanced microstrip feed of claim 1 wherein said first vertical stem and said second vertical stem are the same height, h, and wherein said first horizontal arm and said second horizontal arm are the same length, L.

6. The linearly polarized dipole antenna with an unbalanced microstrip feed of claim 1 wherein said ground plane has a length of Y and a width of X.

7. The linearly polarized dipole antenna with an unbalanced microstrip feed of claim 1 wherein said substrate has a thickness of t and a dielectric constant value of $\in$.

8. The linearly polarized dipole antenna with an unbalanced microstrip feed of claim 1 wherein when an electrical signal is input to said microstrip feed line, said antenna radiates.

9. The linearly polarized dipole antenna with an unbalanced microstrip feed of claim 1 wherein when an electrical signal is input to said microstrip feed line, a current flow is created in said first dipole element which induces a nearly equal current on said second dipole element that is out of phase resulting in a current flow, I, in the same direction in both said first dipole element and said second dipole element.

10. The linearly polarized dipole antenna with an unbalanced microstrip feed of claim 1 wherein said first vertical stem has a first height, h, and said second vertical stem has a second height, different from said first height.

11. The linearly polarized dipole antenna with an unbalanced microstrip feed of claim 1 wherein said first horizontal arm has first length, L1, and said second horizontal arm has a second length, L2, that is different from said first length, L1.

* * * * *